United States Patent [19]

Howard

[11] Patent Number: 4,747,328

[45] Date of Patent: May 31, 1988

[54] SWIVEL ARM RATCHET WRENCH

[76] Inventor: Leslie Howard, 6018 Edge Lake Dr., Virginia Beach, Va. 23464

[21] Appl. No.: 68,770

[22] Filed: Jun. 29, 1987

Related U.S. Application Data

[63] Continuation of Ser. No. 876,836, Jun. 20, 1986, abandoned.

[51] Int. Cl.[4] ..... B25B 13/00

[52] U.S. Cl. ..... 81/54; 81/58.1; 81/177.8; 81/60

[58] Field of Search ..... 81/177.8, 177.9, 58.3, 81/58.5, 58, 60, 54, 59.1, 57.13, 57.29, 28, 29, 35–37, 58.1

[56] References Cited

U.S. PATENT DOCUMENTS

| | | | |
|---|---|---|---|
| 974,772 | 11/1910 | Bersted | 81/177.8 |
| 987,880 | 3/1911 | Horstman . | |
| 1,076,793 | 10/1913 | Seipel . | |
| 1,109,032 | 9/1914 | Bersted . | |
| 1,191,967 | 7/1916 | Henriksen . | |
| 1,234,765 | 7/1917 | Iverson . | |
| 1,316,044 | 9/1919 | King . | |
| 1,360,051 | 11/1920 | Strang . | |
| 1,379,536 | 5/1921 | Davies . | |
| 1,384,887 | 7/1921 | Burndahl . | |
| 1,429,386 | 9/1922 | Watson . | |
| 1,615,169 | 1/1925 | Ellis . | |
| 2,680,983 | 6/1954 | Miller . | |
| 2,712,765 | 7/1955 | Knight, Jr. . | |
| 2,786,379 | 3/1957 | Blackinton | 81/54 |
| 3,004,455 | 10/1961 | Bashore et al. | 81/177.9 |
| 3,270,597 | 9/1966 | Neff et al. . | |
| 3,383,962 | 5/1968 | Harris . | |
| 3,550,486 | 12/1970 | Edwards . | |
| 4,128,025 | 12/1978 | Main et al. | 81/57.29 |
| 4,406,186 | 9/1983 | Gummow . | |
| 4,463,632 | 8/1984 | Parke . | |

*Primary Examiner*—Frederick R. Schmidt
*Assistant Examiner*—Bradley I. Vaught
*Attorney, Agent, or Firm*—Stevens, Davis, Miller & Mosher

[57] ABSTRACT

Ratchet wrench composed of a head having a ratchet system for controlling or locking the shank of the ratchet wrench. Connected to the head of the wrench through a neck is a cylinder structure. The cylinder structure includes circumferentially spaced longitudinal grooves and is connected to an arm by casing means. The arm has a central bore and a locking pin therethrough for locking or unlocking the arm to the cylinder. In the locked position, where the locking pin is engaged with a groove of the cylinder, the wrench can be used in a conventional manner. In the unlocked position, when the locking pin end is retracted from a groove the arm of the wrench is capable of being manipulated to rapidly rotate a bolt or a nut or to conveniently position the arm when a tight or close quarter area is encountered.

7 Claims, 4 Drawing Sheets

Prior Art

SWIVEL ARM RATCHET WRENCH

This application is a continuation of application Ser. No. 876,836 filed June 20, 1986, now abandoned.

BACKGROUND OF THE INVENTION

1. Field of the Invention

This invention relates to a ratchet wrench having a ratchet head, a pivotal arm and a locking pin for securely locking or unlocking the arm to the ratchet head. In the unlocked position the ratchet head can be rapidly rotated by manipulating or maneuvering the arm to secure or remove a loosely fitted bolt or fastener. In the locked position, the device is used in the manner of a conventional ratchet wrench to torque the bolt or nut in either direction. When the bolt or nut is in a restricted location or the arm encounters an obstruction the arm can be unlocked and then rotated to any position about the ratchet head or away from the obstruction and then relocked for torquing the bolt or nut.

2. Description of the Prior Art

It is known in the art to construct a ratchet so that the head or shank of the ratchet can be rotated rapidly. It is also known that such a feature can be employed with a second feature that allows for the conventional torquing of a bolt by an adjustment of the wrench. For instance, U.S. Pat. No. 4,406,186 to Gummow relates to a ratchet wrench composed of a wrench body having a shank, a handle and a pivot pin. The handle is connected to the wrench body through the pivot pin. By moving the pivot from an initial downward locking position to the up position the wrench handle can be moved from a position where it is locked against angular movement with respect to the wrench body to a clearing position. In this position the wrench body may be freely rotated about the pivot pin.

Although the ratchet wrench embodied in the '186 patent allows for the rapid rotation of its head and shank to rapidly loosen a nut or bolt, the device is incapable of rapid rotation where it is desired to quickly rotate a bolt in an area not easily accessible. Where the bolt is in a particularly tight or close quarter position, the pivot pin mechanism of the '186 patent must still be raised by the users hand. The position of the bolt in such a case may make the adjustment impossible, and thus the desired rapid rotation impossible. Additionally, it would appear that the mechanisms pivot pin may slip during use, frustrating attempts to remove the nut.

Accordingly, it is an object of this invention to eliminate the deficiencies of the prior art.

Another object of the invention is to provide a ratchet wrench whose arm can be operated in a first mode to rapidly spin a bolt or nut on and off its mating structure and which can be operated in a second conventional mode to torque the bolt or nut.

Still another object of the invention is to provide a ratchet wrench whose arm can be easily maneuvered away from an obstruction without the user having to resort to holding the spanner or socket during such motion.

Still another object of the present invention is to provide a ratchet wrench whose arm can operate in one or the other of fast or conventional modes as described above, which additionally includes means where either mode may be changed by a user in an easy and quick manner even where the bolt or nut is positioned in a restricted access area.

BRIEF SUMMARY OF THE INVENTION

The ratchet wrench of this invention is composed of a head having a ratchet system for controlling or locking the shank of the ratchet wrench. A conventional socket or spanner can be connected to the shank. Connected to the head of the wrench through a neck is a cylindrical structure. The cylindrical structure includes circumferentially spaced longitudinal grooves and is enclosed by casing means. The arm of the ratchet has a central bore and a locking pin therethrough for locking or unlocking the arm to the cylinder. In the locked position, where the locking pin is engaged with a groove of the cylinder, the wrench can be used in a conventional manner. In the unlocked position, when the locking pin end is retracted from a groove the arm of the wrench is capable of being manipulated to rapidly rotate a bolt or a nut or to conveniently position the arm when a tight or a close quarter area, is encountered. The arm also may be moved away from an obstruction when unlocked from the cylinder.

BRIEF DESCRIPTION OF THE DRAWINGS

The above and other objects, advantages and features of the present invention will be more fully understood when considered in conjunction with the following figures of which.

DESCRIPTION OF THE INVENTION

The foregoing objects and others are accomplished in accordance with this invention by constructing a ratchet having a cylinder positioned between a ratchet head and a ratchet arm. The cylinder has spaced longitudinal grooves which receive a locking pin that locks the arm to the cylinder allowing the wrench to be used in a conventional manner. When the locking pin is removed from a groove, the arm can be maneuvered so that the ratchet head, which houses a shank that receives a socket or spanner for engaging a bolt or nut is rapidly rotated. Maneuvering the handle and ensuring that the shank is driven in the clockwise direction causes a loosely fitted bolt or nut to be rapidly secured onto a mating structure. In order to snugly tighten the bolt or nut it is necessary that the locking pin mate with a spaced groove of the cylinder so that the ratchet may be used in a conventional manner. To loosen a bolt or nut, the locking pin is again retained by a groove and the shank of the ratchet is caused to move in the counterclockwise position. As the bolt or nut loosens, the locking pin again may be disengaged from a groove of the cylinder so that the head of the wrench may be rapidly rotated to remove the nut or bolt. When using the wrench in a conventional manner to tighten or loosen a nut or bolt in a confined area the pivot arm, on turning, may encounter an obstruction. When this happens the locking pin can be extracted from a groove of the cylinder and the arm may be rotated relative to the cylinder and ratchet head, away from the obstruction. The locking pin may then be returned to a groove and the wrench again used in a conventional manner. Rotating the arm in this way prevents the socket or spanner from having to be removed to a new position to avoid the obstruction.

Figure 1:
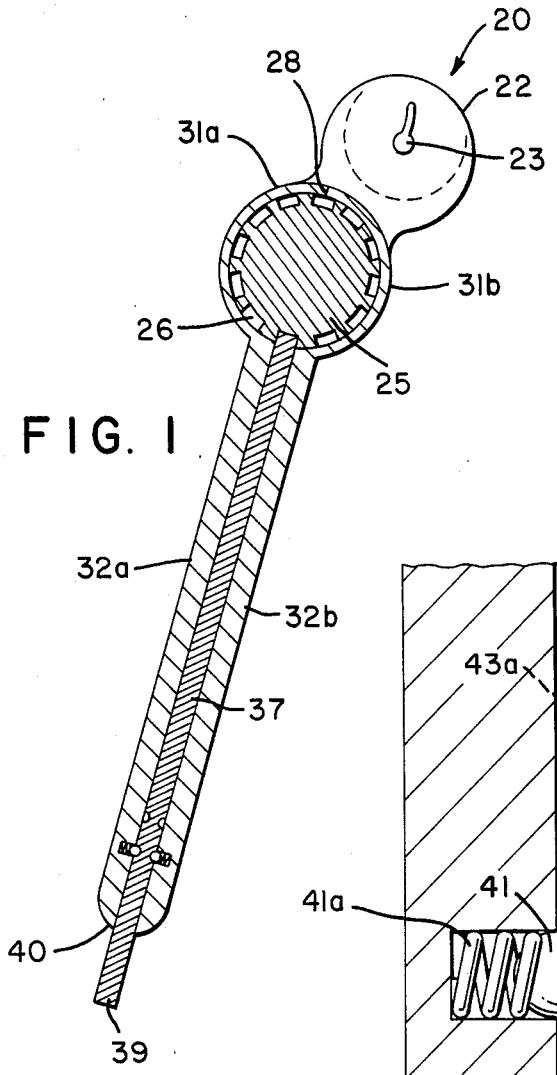
FIG. 1 is a top sectional view of the ratchet wrench of the present invention showing one-half of the casing, and the locking pin engaged.
Figure 2:
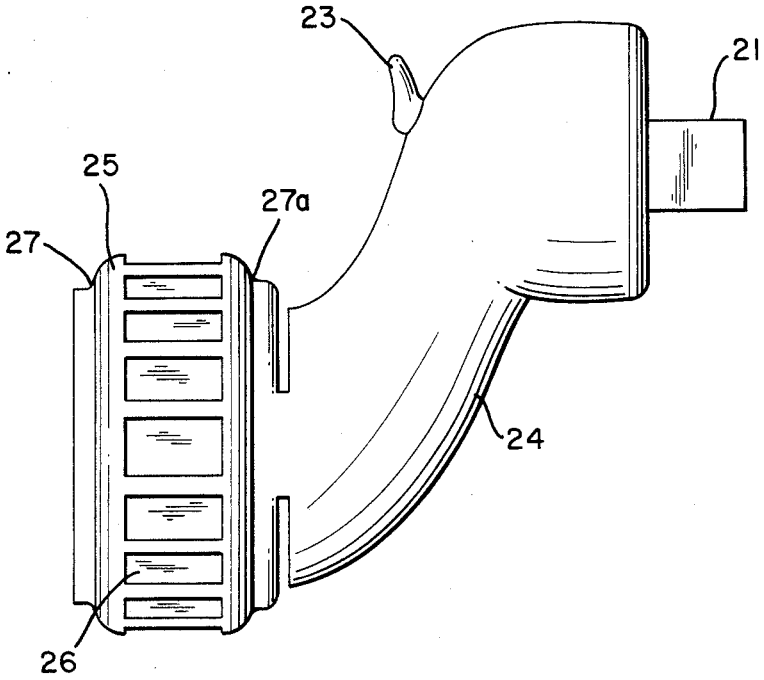
FIG. 2 is a side view of the cylinder and ratchet head.
Figure 3:
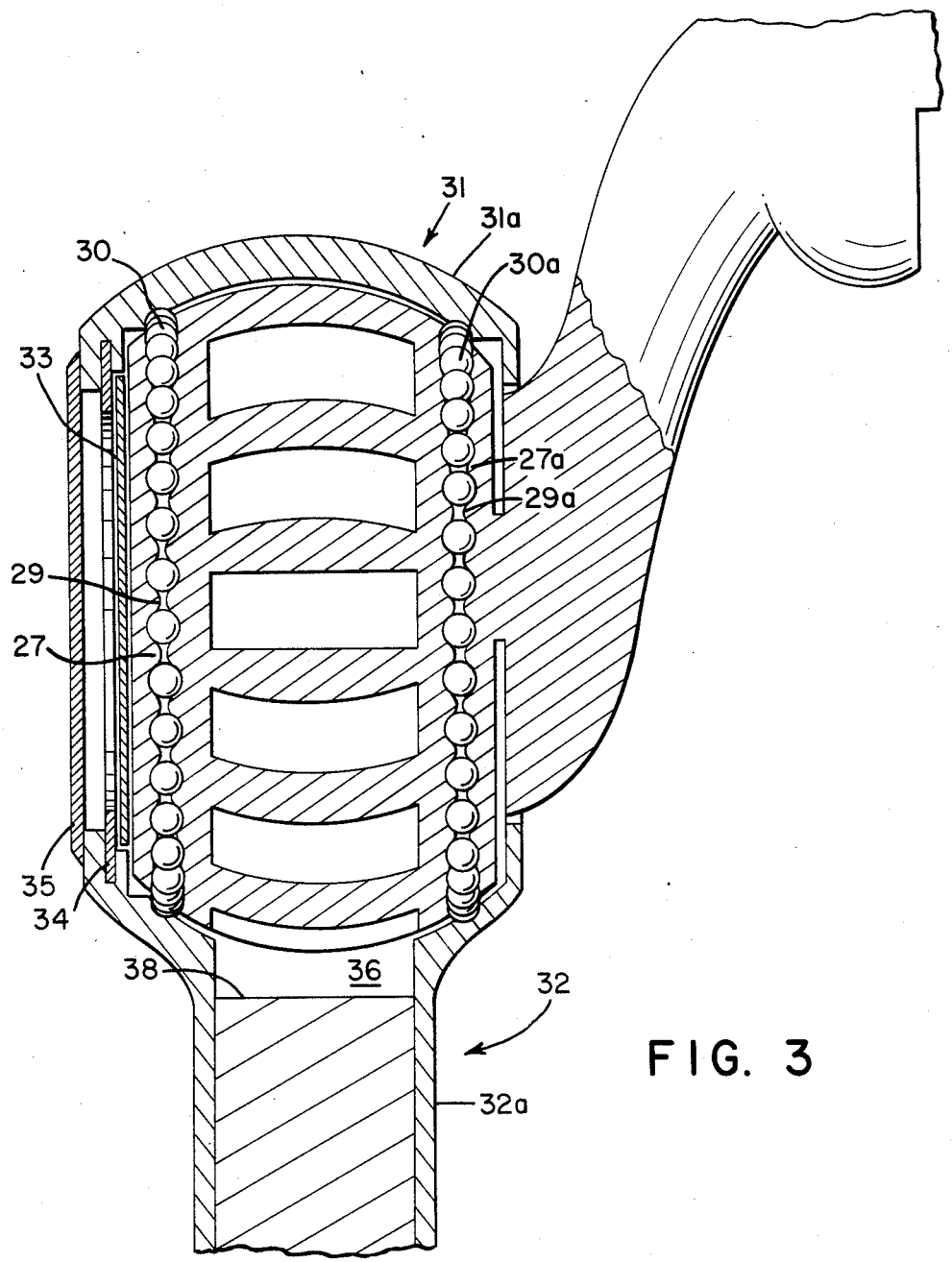
FIG. 3 is a magnified view partly in section of the cylinder and casing.

With reference to FIGS. 1 to 3, the ratchet wrench 20 is composed of a shank 21 connected to a ratchet system (not shown). The ratchet system is housed in the ratchet head 22, and a portion of the shank is rotatably housed in the head 22. The shank 21 receives a spanner or socket (not shown). The ratchet system includes a ratchet direction selector 23 which may be positioned so that the shank 21 can be driven in a clockwise direction, or a counterclockwise direction. Such a ratchet system is found in U.S. Pat. No. 4,406,186 which is hereby incorporated by reference.

A gooseneck 24 extends from the head 22 and is integrally connected with cylinder 25. The cylinder, more particularly shown in FIGS. 2 and 3, has a plurality of circumferentially spaced longitudinal grooves 26 which extend parallel to the axis of the cylinder 25 and the axis of the rotatable shank 21. Additionally, the cylinder has two annular grooves 27 and 27*a* perpendicular to the axis of the cylinder 25 and the axis of the rotatable shank 21. A first annular groove 27 is positioned away from the neck 24 and to the left of the circumferentially spaced grooves 26 and a second annular groove 27*a* is positioned to the right of the circumferentially spaced grooves 26. The annular grooves 27 and 27*a* house split ball bearing rings 29 and 29*a* and ball bearings 30 and 30*a*, respectively. The cylinder is enclosed by casing 31 and is mounted solidly onto the neck 24 of the ratchet and does not rotate. Casing 31 defines arm 32. Casing 31 is constructed by welding two halves of the casing 31*a*, 31*b* together. Casing 31*a* includes one-half the arm 32*a*, and one-half of the structure that surrounds the cylinder 25. Casing piece 31*b* includes a second half of arm 32*b* and the remaining structure that surrounds the cylinder 25. Prior to joining the two pieces by welding, the cylinder 25 is seated along with split bearing rings 29 and 29*a* and plate 33 within the casing piece 31*a* of the casing. Upon welding the two pieces of the casing the cylinder 25 is securely positioned inside the casing 31. Casing 31 and arm 32 are thereafter rotatable about the cylinder and this rotation is facilitated by ball bearing structures 29, 29*a*, 30 and 30*a*. Plate 33 is employed to reduce the play between the casing 31 and the cylinder 25 and is held in place by lock ring 34. A dust palte 35 provides a cover for the casing 31, cylinder 25, plate 33 and lock ring 34. Lock ring 34 is positioned after the casing pieces 31*a* and 31*b* are welded together. Weld 28 is shown in FIG. 1.

Figure 4:
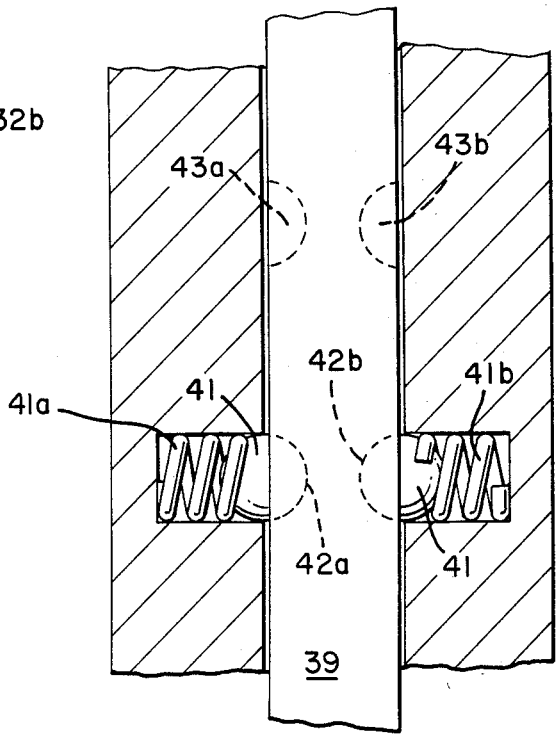
FIG. 4 is a magnified view of a portion in section, of the rear of the arm of FIG. 1 showing the mechanism for retaining the locking pin in the locked or unlocked position.

The arm 32 has an axially extending rectangular bore 36 passing completely through its center and an elongated rectangular shaped locking pin 37 complementary to bore 36 and fitting snugly within rectangular bore 36. End 38 of the locking pin 37 retractably engages any one of the spaced longitudinal grooves 26 of the cylinder 25. In the engaged position, i.e., the locked position, the opposite end 39 of the elongated locking pin 37 extends beyond the end 40 of the arm 32. To keep end 38 of the locking pin within a groove 26 of the cylinder 25 the arm 32, near its end 40, has opposing notches 42*a* and 42*b* into which fit spring-detent ball structures, 41*a* and 41*b*, perpendicular to axial bore 36. The detent balls 41 mate with one or two sets of semi-spherical notches 42*a* and 42*b* and 43*a* and 43*b* located on the locking pin 37. When ball detents 41 are resting in semi-spherical notches 42*a* and 42*b*, as shown in FIG. 4, the end 38 of locking pin 37 is seated within one of the spaced grooves 26 of the cylinder 25. Longitudinally pulling on the end 39 of the locking pin 37 causes the ball detents to be forced against their springs, unseating them from notches 42*a* and 42*b*. Continued pulling of the arm 32 aligns the ball detents with notches 43*a* and 43*b* to maintain locking pin 37 in the unlocked position. The tightness of the fit between the axial bore 36 and the locking pin 37 prevents the notches and detents from becoming unaligned. When the locking pin 37 is seated within or engages one of the circumferentially spaced grooves 26 of the cylinder 25, the ratchet 20 can be used in a conventional manner to loosen tightened nuts or bolts, to tighten loose nuts or bolts, or to secure or remove nuts or bolts when they are easily accessible.

Figure 5:
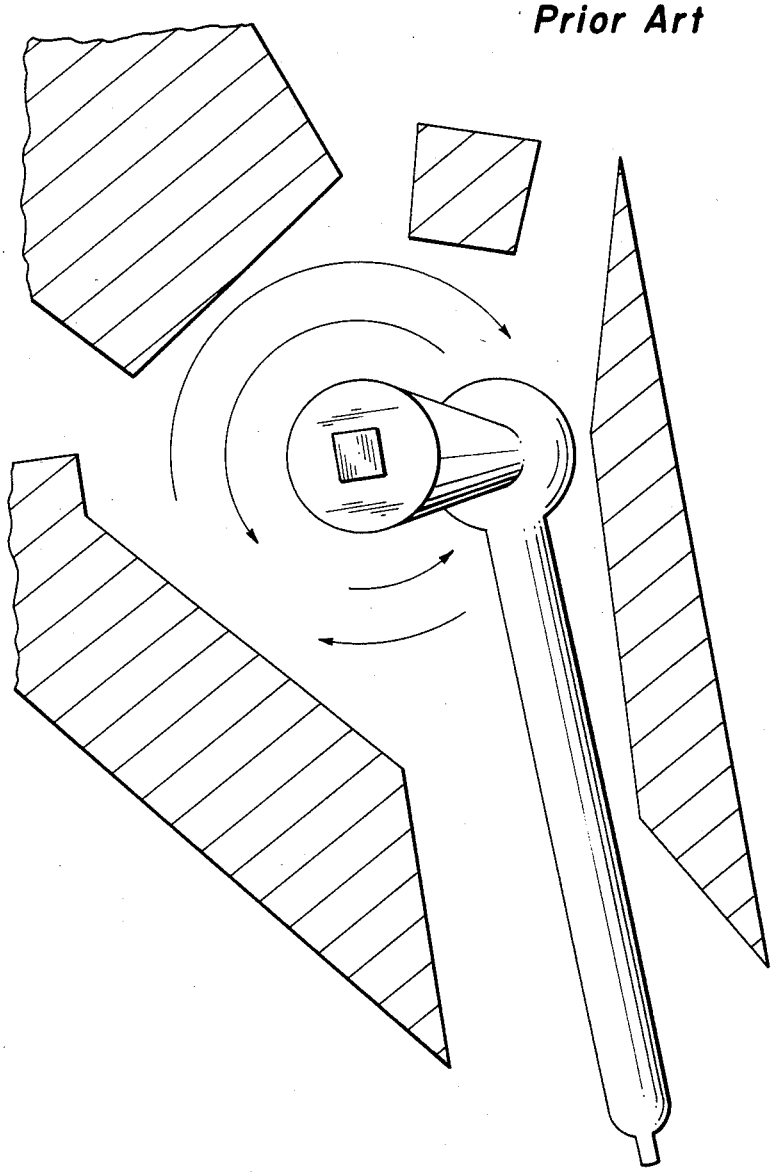
FIG. 5 shows a conventional ratchet which can only move in a 45° area while a swivel arm could move up to 360° in the same area.

In manipulating a ratchet wrench in the conventional manner the arm frequently comes in contact with an obstruction especially where the nut or bolt is secured or to be placed in a tight or close quarter area (FIG. 5). Unlocking the handle by removing the locking pin from a groove of a cylinder allows the handle to be rotated about the cylinder to a more convenient position. Rotating the arm about the cylinder, away from the obstruction, allows the user to relock the pivotal arm in a different position. The wrench having its arm free of the obstruction can then be used in the conventional manner. This second motion is particularly advantageous because in unlocking the arm from the cylinder a force is prevented from being transmitted from the pivotal arm to the ratchet head. This prevents the shank from moving when the arm is moved away from the obstruction. With a conventional ratchet, such movement of the shank is prevented by grabbing onto the spanner or socket during rotating movement of the handle. The pivotal arm of the invention frees the user from the necessity of grabbing and holding onto the socket or spanner.

While specific embodiments of the apparatus and methods of using the apparatus have been shown and described it should be apparent that many modifications can be made thereto without departing from the spirit and scope of the invention. Accordingly, the invention is not limited by the foregoing description, but is only limited by the scope of the claims appended thereto.

I claim:

1. A ratchet wrench comprising:

a rotatable shank means for receiving a socket;

a head for housing a portion of said rotatable shank means;

a ratchet means positioned within said head for determining the direction of rotation of said shank means;

a neck extending from said head and integrally terminating with a cylinder offset from said head, said cylinder having circumferentially spaced grooves which extend parallel to the axis of said cylinder and the axis of said rotatable shank, and completely surround the cylinder;

a housing for said cylinder having an arm extending therefrom, said housing being rotatably mounted on said cylinder through 360°, said arm having a longitudinal bore extending therethrough; and an elongated locking pin mounted within said bore and of a length longer than said bore whereby an end of said pin may be seated within each of said completely surrounding spaced grooves to lock said arm relative to said neck by pushing the locking pin longitudinally from an opposing rear end.

2. The ratchet wrench of claim 1, wherein said cylinder defines means for facilitating the pivotal movement of said arm.

3. The ratchet wrench of claim 2, wherein said means for facilitating pivotal movement of said arm is a pair of annular grooves perpendicular to the axis of said cylinder and the rotatable axis of said shank, said annular grooves being positioned on either side of said circumferentially spaced grooves.

4. The ratchet wrench of claim 3, including a ball bearing ring for each annular groove in said cylinder.

5. The ratchet wrench of claim 1, wherein said cylinder defines annular grooves for facilitating pivotal movement of said handle on either side of said circumferentially spaced grooves and includes ball bearing rings for said grooves.

6. The ratchet wrench of claim 1, further comprising a pair of opposing ball detents within a rear portion of said arm and two pairs of notches, said notches positioned on said locking pin, each notch opposing its paired member, wherein said ball detents engage with said notches to secure said locking pin in a desired position.

7. A ratchet wrench comprising:

a rotatable shank means for receiving a socket;

a head for housing a portion of said rotatable shank means;

a ratchet means positioned within said head for determining the direction of rotation of said shank means;

a neck extending from said head and terminating with a cylinder having circumferentially spaced grooves extending parallel to the axis of said cylinder and the axis of said rotatable shank, said cylinder defining two annular grooves on either side of said circumferentially spaced grooves perpendicular to the axis of said cylinder and the axis of said shank;

a housing for said cylinder having an arm extending therefrom, said housing being rotatably mounted on said cylinder, said arm having a longitudinally extending bore therethrough;

ball bearing rings, positioned within said annular grooves; and an elongated locking pin mounted within said bore and of a length longer than said bore, said pin having two pairs of notches, a first end of said pin seatable within a said circumferentially spaced groove to lock said arm relative to said neck, said arm having a pair of opposing ball detents registerable with said notches to secure said locking pin in a locked or unlocked position.

* * * * *